US009909815B2

(12) United States Patent
Lan

(10) Patent No.: US 9,909,815 B2
(45) Date of Patent: Mar. 6, 2018

(54) ASSEMBLING STRUCTURE OF HEAT DISSIPATION DEVICE

(71) Applicant: ASIA VITAL COMPONENTS CO., LTD., New Taipei (TW)

(72) Inventor: Wen-Ji Lan, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 82 days.

(21) Appl. No.: 14/956,336

(22) Filed: Dec. 1, 2015

(65) Prior Publication Data

US 2017/0153065 A1 Jun. 1, 2017

(51) Int. Cl.
*F28D 15/02* (2006.01)
*F28F 1/32* (2006.01)

(52) U.S. Cl.
CPC ..... *F28D 15/0275* (2013.01); *F28F 1/32* (2013.01); *F28F 2215/04* (2013.01)

(58) Field of Classification Search
CPC ... F28D 15/0283; F28D 15/04; B23P 2700/09
USPC ..... 165/80.4
See application file for complete search history.

(56) References Cited

U.S. PATENT DOCUMENTS 6,978,829 B1 * 12/2005 Lin ..... F28D 15/0275 165/104.21
7,100,681 B1 * 9/2006 Wu ..... F28D 15/0266 165/104.21
2003/0141041 A1 * 7/2003 Chen ..... F28F 1/32 165/80.3
2005/0263265 A1 * 12/2005 Sheng ..... F28F 1/32 165/104.21
2007/0144710 A1 * 6/2007 Cheng ..... H01L 23/427 165/104.33
2010/0319880 A1 * 12/2010 Yu ..... H01L 23/427 165/104.26
2012/0241132 A1 * 9/2012 Huang ..... F28D 15/0275 165/104.26

FOREIGN PATENT DOCUMENTS

CN 201197255 Y 2/2009
CN 102117787 A 7/2011
TW 557125 U 10/2003
TW M429314 U1 5/2012
TW M515761 U 1/2016

* cited by examiner

*Primary Examiner* — Jianying Atkisson
*Assistant Examiner* — Paul Schwarzenberg
(74) *Attorney, Agent, or Firm* — C. G. Mersereau; Nikolai & Mersereau, P.A.

(57) ABSTRACT

An assembling structure of heat dissipation device includes at least one heat pipe, a first and a second radiating fin assembly. The heat pipe has a heat absorption section, at least one heat releasing section and a curved section between the heat absorption section and the heat releasing section. The heat releasing section is fitted in multiple perforations of the second radiating fin assembly. The curved section is fitted in multiple notches of the first radiating fin assembly. Each notch is defined with an open side and a closed side. The closed side extends along a curved outer side of the curved section and contacts and attaches to the curved outer side of the curved section. Accordingly, the utility ratio of the heat pipe is increased. Also, the heat dissipation area of the heat pipe is increased and the heat dissipation efficiency of the heat dissipation device is enhanced.

6 Claims, 4 Drawing Sheets

ASSEMBLING STRUCTURE OF HEAT DISSIPATION DEVICE

BACKGROUND OF THE INVENTION

1. Field of the Invention

The present invention relates generally to an assembling structure of heat dissipation device, and more particularly to an assembling structure of heat dissipation device, which can enlarge the heat dissipation area of the heat pipe and increase the utility ratio of the heat pipe.

2. Description of the Related Art

In general, an electronic component will generate heat in operation. Especially, along with the recent advance of sciences and technologies, the functions and performances of various electronic products have been greatly promoted. As a result, the heat generated inside the electronic products has been more and more increased. In order to dissipate the heat in time, most of the electronic components necessitate heat dissipation devices so as to control the working temperature and keep the electronic components normally operating. A heat sink composed of multiple radiating fins stacked layer by layer and heat pipes passing through the radiating fins is one of the most often seen heat dissipation devices.

The conventional heat dissipation device generally includes a heat conduction seat, multiple heat pipes and multiple radiating fins. The bottom side of the heat conduction seat is attached to a heat generation component (such as a processor or a graphics processor). The heat pipes are U-shaped heat pipes. Each heat pipe includes a horizontal heat absorption section and two heat releasing sections respectively extending from two ends of the heat absorption section. The heat absorption section of the heat pipe is inlaid in the other side of the heat conduction seat opposite to the bottom side. The heat releasing sections of the heat pipes pass through and connect with the radiating fins one by one. The heat generated by the heat generation component is first conducted to the heat conduction seat. Then the heat conduction seat transfers the heat to the heat pipes. Finally, the heat is transferred by the heat pipes to the radiating fins. Thereafter, the surfaces of the radiating fins will heat-exchange with the ambient air to dissipate the heat to the air.

The conventional heat dissipation device is able to achieve heat dissipation effect. However, in practice, the conventional heat dissipation device still has some shortcomings. That is, when the heat pipes are connected with the radiating fins, only the vertical sections (the heat releasing sections) of the heat pipes can pass through and connect with the radiating fins. In the current technique, the curved sections between the heat absorption sections and the heat releasing sections still cannot be such designed as to pass through and connect with the radiating fins. As a result, the spaces of the curved sections of the heat pipes are limited and can be hardly effectively utilized. The spaces can be only reserved for the air to pass through. This lowers the utility ratio of the heat pipe and cannot enlarge the heat dissipation area of the heat pipe. In addition, due to the promotion of the power of the heat generation component and the design of limited space, the heat dissipation area has been saturated. This will affect the heat dissipation performance of the entire heat dissipation device. All the above shortcomings of the conventional heat dissipation device need to be overcome.

SUMMARY OF THE INVENTION

It is therefore a primary object of the present invention to provide an assembling structure of heat dissipation device, which can increase the utility ratio of the heat pipe and enlarge the heat dissipation area of the heat pipe.

It is a further object of the present invention to provide the above assembling structure of heat dissipation device, which can enhance the heat dissipation efficiency of the heat dissipation device.

To achieve the above and other objects, the assembling structure of heat dissipation device of the present invention includes at least one heat pipe, a first radiating fin assembly and a second radiating fin assembly. The heat pipe has a heat absorption section, at least one heat releasing section and a curved section connected between the heat absorption section and the heat releasing section. The first radiating fin assembly includes multiple first radiating fins stacked on each other. Each first radiating fin has multiple notches. The curved section is fitted in the corresponding notch. Each notch is defined with an open side and a closed side opposite to the open side. The closed side extends along a curved outer side of the curved section and is attached to the curved outer side of the curved section. The second radiating fin assembly is correspondingly connected with the first radiating fin assembly. The second radiating fin assembly has multiple second radiating fins stacked on each other. Each second radiating fin is formed with multiple perforations. The heat releasing section is fitted in the corresponding perforations. By means of the structural design of the present invention, the utility ratio of the heat pipe is effectively increased. Also, the heat dissipation area of the heat pipe is enlarged and the heat dissipation performance of the entire heat dissipation device is enhanced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
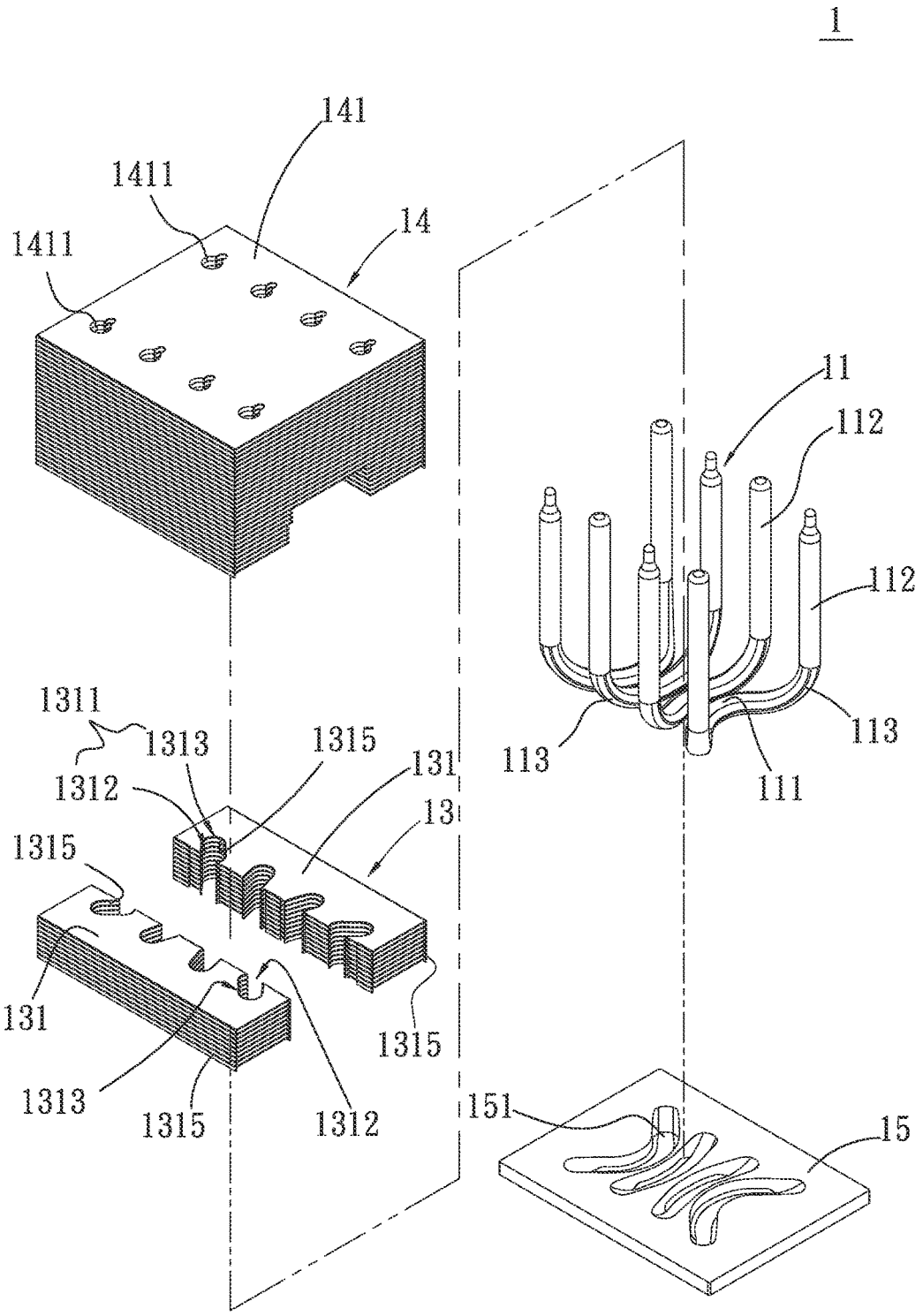
FIG. 1 is a perspective exploded view of a preferred embodiment of the present invention.
Figure 2:
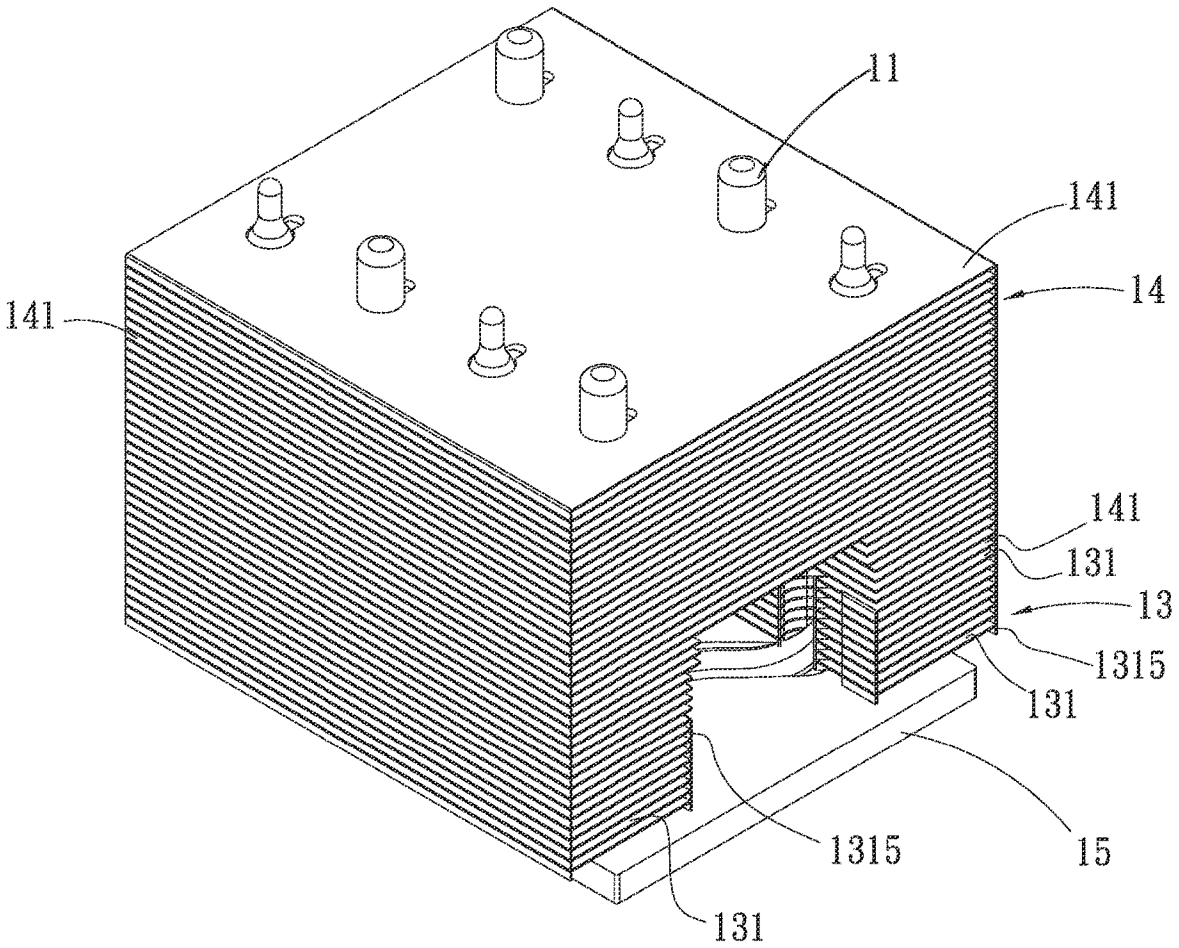
FIG. 2 is a perspective assembled view of the preferred embodiment of the present invention.

Please refer to FIGS. 1 and 2. FIG. 1 is a perspective exploded view of a preferred embodiment of the present invention. FIG. 2 is a perspective assembled view of the preferred embodiment of the present invention. The assembling structure of heat dissipation device of the present invention is applied to and mounted on a corresponding heat generation component (such as a processor or a graphics processor) to quickly dissipate the heat generated by the heat generation component.

Figure 3:
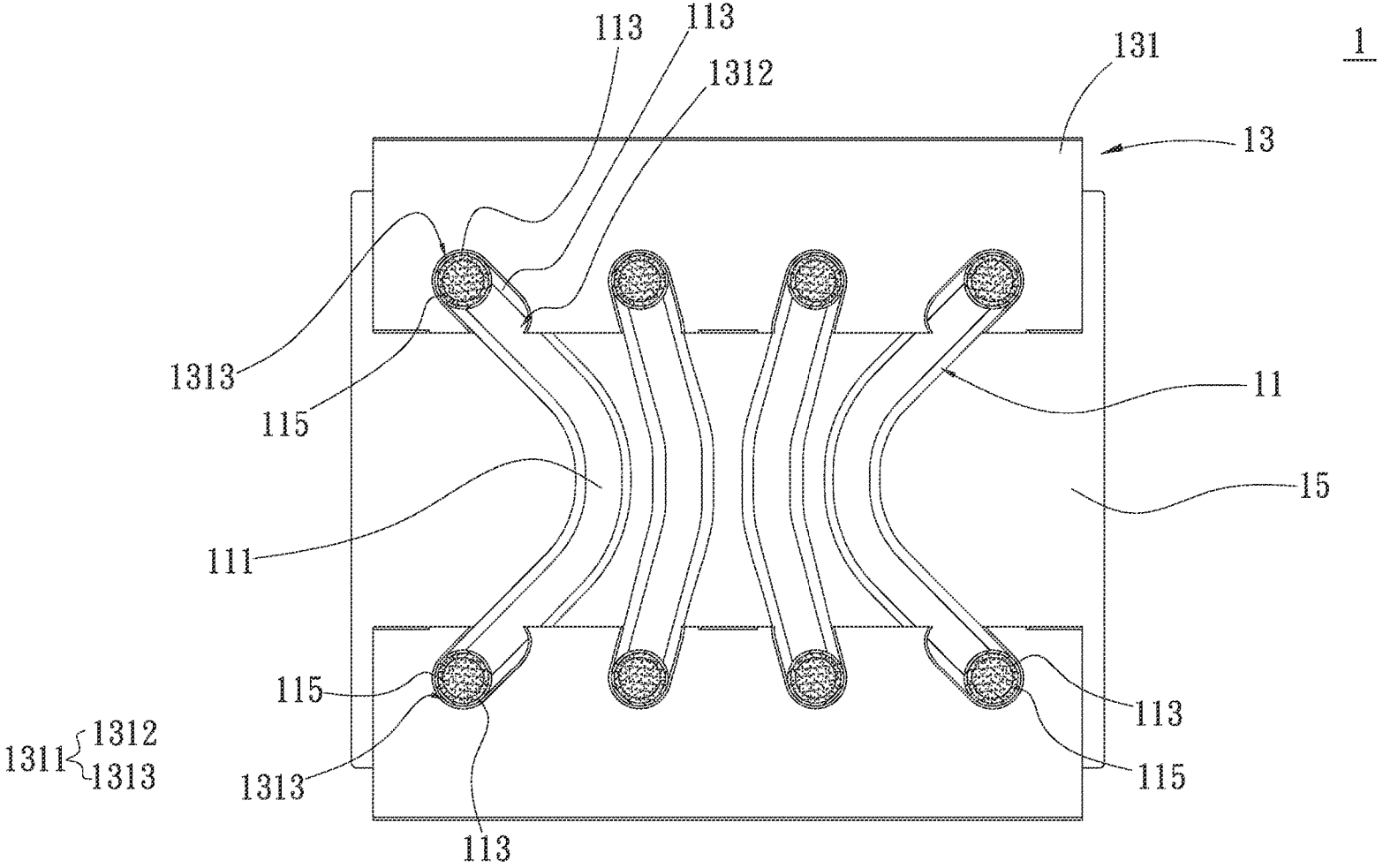
FIG. 3 is a top assembled view of a horizontal section of the preferred embodiment of the present invention, showing that the curved sections of the heat pipes are assembled in the notches of the first radiating fin assembly.

Also supplementally referring to FIG. 3, the assembling structure 1 of heat dissipation device of the present invention includes at least one heat pipe 11, a first radiating fin assembly 13, a second radiating fin assembly 14 and a base seat 15. In this embodiment, there are, but not limited to, four heat pipes 11 for illustration purposes only. In practice, the number of the heat pipes 11 can be one or two or more. The heat pipe 11 is substantially U-shaped, having a heat absorption section 111, a left heat releasing section 112, a right heat releasing section 112 in parallel to the left heat releasing section 112 and curved sections 113 connected between the heat absorption section 111 and the heat releasing sections 112. The heat absorption section 111 is a flat horizontal section. The heat releasing sections 112 are vertical sections normal to the horizontal section. A capillary structure 115 (such as sintered powder body, metal mesh body, channeled body or fibers) is disposed in the heat pipe 11. A working fluid (such as pure water or methanol) is filled in the heat pipe 11.

The base seat 15 has the form of a board body and is formed with at least one channel 151. In this embodiment, there are, but not limited to, four channels 151 for illustration purposes only. The channels 151 pass through the base seat 15. The heat absorption section 111 of the heat pipe 11 is received in the channel 151 and securely connected with the base seat 15 by means of welding or adhesion. The heat absorption section 111 of the heat pipe 11 serves to absorb the heat coming from the base seat 15. Moreover, the upper and lower sides of the heat absorption section 111 are correspondingly flush with the top face and bottom face of the base seat 15. The heat releasing sections 112 are positioned on upper side of the base seat 15 and substantially normal to the base seat 15.

Figure 4:
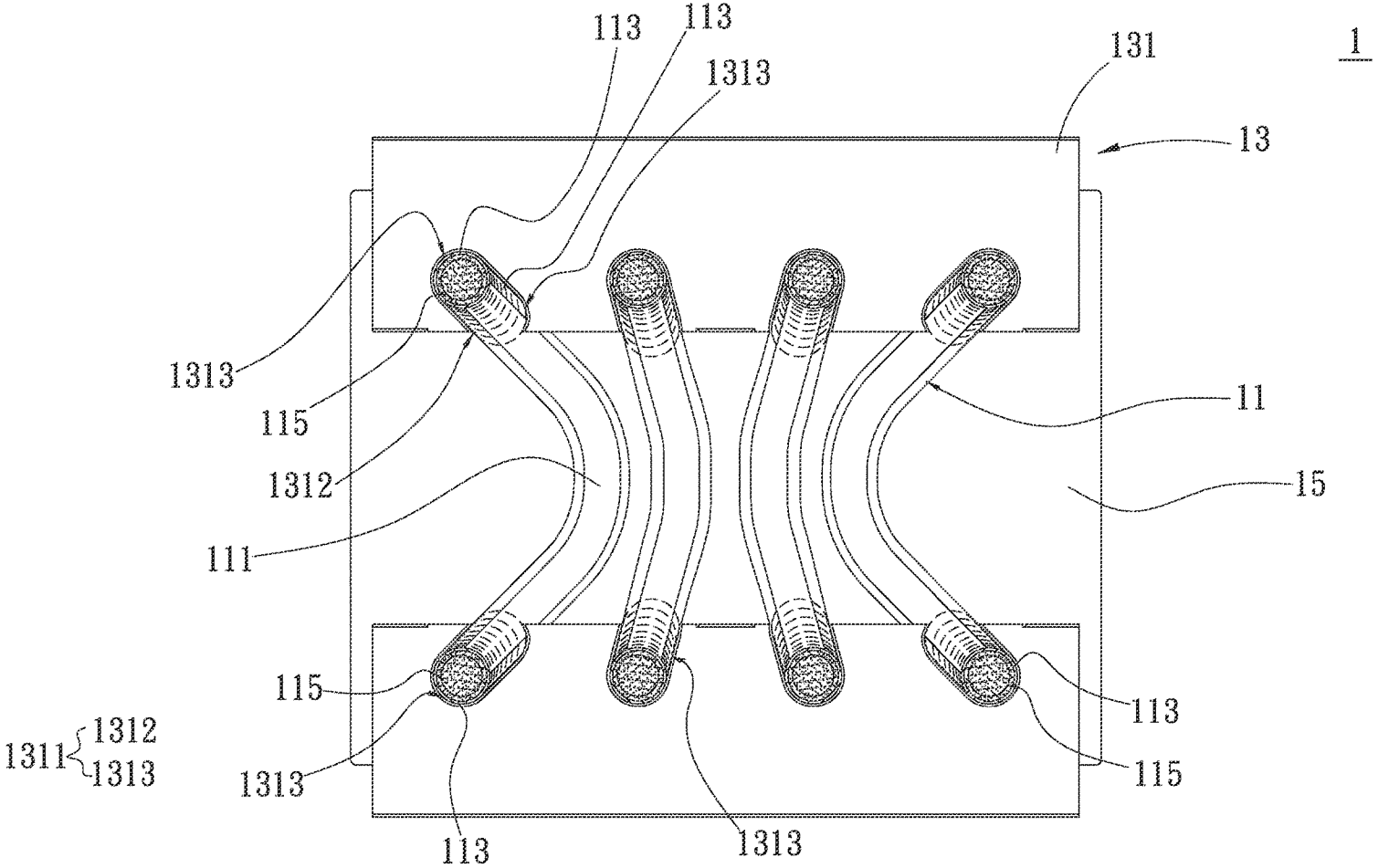
FIG. 4 is another top assembled view of a horizontal section of the preferred embodiment of the present invention, showing that the curved sections of the heat pipes are assembled in the notches of the first radiating fin assembly.

The first radiating fin assembly 13 is composed of multiple first radiating fins 131 stacked on each other. Each first radiating fin 131 has multiple notches 1311. The notch 1311 correspondingly extends in a direction along the extending direction of the curved section 113 of the heat pipe 11. The curved section 113 of the heat pipe 11 is fitted in the corresponding notch 1311. Each notch 1311 is defined with an open side 1312 and a closed side 1313 opposite to the open side 1312. The closed side 1313 extends along a curved outer side of the curved section 113 and is attached to the curved outer side of the curved section 113. In addition, the outer-side profile line of the horizontal section of the curved section 113 of the heat pipe 11, which is correspondingly attached to the closed side 1313 of the notch 1311, is partially in conformity with a part of the profile line of the closed side 1313 of the notch 1311 (as shown in FIG. 3). For example, referring to FIG. 4, there are eight horizontal sections shown by phantom lines. The phantom lines are the outer-side profile lines of the eight horizontal sections that are downward sequentially positioned from a portion of the curved section 113 in adjacency to the heat releasing section 112 above to the heat absorption section 111 below. Therefore, it can be clearly seen from FIG. 4 that the outer-side profile line of every horizontal section of the curved section 113 is partially tightly attached to a part of the profile line of the closed side 1313 of the corresponding notch 1311. Accordingly, both the heat releasing sections 112 and the curved sections 113 of the heat pipes 11 can be fully utilized to respectively contact the corresponding first and second radiating fins 131, 141 and effectively enhance the utility ratio of the heat pipe 11 and further effectively enlarge the heat dissipation area. Therefore, the heat dissipation effect of the assembling structure 1 of heat dissipation device can be enhanced as a whole. In this embodiment, by means of a tool, two first radiating fin assemblies 13 composed of multiple stacked first radiating fins 131 are entirely directly respectively leant against the curved sections 113 of the corresponding heat pipes 11 into contact therewith at one time. Thereafter, by means of welding, the curved outer sides of the curved sections 113 of the heat pipes 11 are connected with the contact sections of the closed sides 1313. Therefore, the assembling time is shortened and the assembling process is facilitated and speeded.

In addition, two opposite edges of the first radiating fin 131 are downward bent to form bending edges 1315. The bending edges 1315 of the first radiating fins 131 are stacked on and connected with each other to form the first radiating fin assembly 13. Moreover, the bending edges 1315 of the first radiating fins 131 in the notches 1311 together form the closed sides 1313 with a larger area. The closed sides 1313 with the larger area contact and attach to the curved outer sides of the corresponding curved sections 113, whereby the heat absorbed by the curved sections 113 of the heat pipes 11 can be quickly conducted to the first radiating fins 131 to dissipate outward.

The second radiating fin assembly 14 is correspondingly connected with the first radiating fin assembly 13 and positioned on upper side thereof. The second radiating fin assembly 14 includes multiple second radiating fins 141 stacked on each other. Each second radiating fin 141 is formed with multiple perforations 1411. The heat releasing sections 112 are fitted in the corresponding perforations 1411. The length of the notches 1311 is larger than the length of the perforations 1411.

Therefore, the heat releasing sections 112 and curved sections 113 of the heat pipes 11 of the present invention can be attached to and connected with the first and second radiating fin assemblies 13, 14. Accordingly, the utility ratio and the heat dissipation area of the heat pipes 11 are increased to effectively enhance the heat dissipation performance of the entire heat dissipation device.

In a modified embodiment of the present invention, a press board (not shown) can be additionally disposed on the top face of the base seat 15. The press board is formed with multiple holes for the heat pipes 11 to pass through. The press board serves to press and fix the heat absorption sections 111 of the heat pipes 11 received in the base seat 15 so as to secure the heat pipes 11 on the base seat 15.

In the above preferred embodiment of the present invention, the heat pipe 11 is not limited to the above substantially U-shaped. Alternatively, the heat pipe 11 can be L-shaped, having a heat absorption section 111, (that is, the flat horizontal section), a heat releasing section 112 normal to the heat absorption section 111, (that is, the vertical section normal to the horizontal section) and a curved section 113 connected between the heat absorption section 111 and the heat releasing sections 112. In the case that an L-shaped heat pipe 11 is employed in the present invention, the heat pipe 11, the base seat 15 and the first and second radiating fin assemblies 13, 14 can be assembled in a manner as the assembling manner of the U-shaped heat pipes 11 of the above preferred embodiment. In addition, the heat absorption sections 111 of the heat pipes 11 can directly contact and attach to the heat generation component without the base seat 15.

In another modified embodiment of the present invention, a latch device (not shown) can be additionally disposed on the top face of the base seat 15. The latch device is positioned on the top face of the base seat 15 between two first radiating fin assemblies 13. The latch device serves to more securely attach the assembling structure of heat dissipation device to the heat generation component.

The present invention has been described with the above embodiments thereof and it is understood that many changes and modifications in the above embodiments can be carried out without departing from the scope and the spirit of the invention that is intended to be limited only by the appended claims.

What is claimed is:

1. An assembling structure of heat dissipation device, comprising:

a base seat having a plurality of channels passing through the base seat, the channels having differing shapes;

a plurality of heat pipes, each heat pipe having a heat absorption section received in a channel, at least one heat releasing section and a curved section connected between the heat absorption section and the heat releasing section, the curved section having a multi-directional curvature;

a first radiating fin assembly composed of multiple first radiating fins stacked on each other, each first radiating fin having multiple notches, the curved section with the multi-directional curvature being fitted in the corresponding notch, each notch being defined with an open side and a closed side opposite to the open side, the closed side extending along a curved outer side of the curved section and being directly in contact with and attached to the curved outer side of the curved section; and a second radiating fin assembly correspondingly connected with the first radiating fin assembly, the second radiating fin assembly having multiple second radiating fins stacked on each other, each second radiating fin being formed with multiple perforations, the heat releasing section being fitted in the corresponding perforations.

2. The assembling structure of heat dissipation device as claimed in claim 1, wherein the notch correspondingly extends in a direction along an extending direction of the curved section with the multi-directional curvature of the heat pipe and an outer-side profile line of the horizontal section of the curved section with the multi-directional curvature of the heat pipe, which is correspondingly attached to and directly in contact with the closed side of the notch, is partially in conformity with a part of the profile line of the closed side of the notch.

3. The assembling structure of heat dissipation device as claimed in claim 2, wherein the edges of the first radiating fin are downward bent to form bending edges, the bending edges of the first radiating fins being stacked on and connected with each other to form the first radiating fin assembly, the bending edges of the first radiating fins in the notches together forming the closed side.

4. The assembling structure of heat dissipation device as claimed in claim 1, wherein the heat pipe has a horizontal section and a vertical section normal to the horizontal section, the horizontal section being the heat absorption section, the vertical section being the heat releasing section.

5. The assembling structure of heat dissipation device as claimed in claim 1, further comprising an upper side and a lower side of the heat absorption section being correspondingly flush with a top face and a bottom face of the base seat.

6. The assembling structure of heat dissipation device as claimed in claim 2, wherein the length of the notches is larger than the length of the perforations.

* * * * *